US010405416B2

(12) United States Patent
Hoffmann et al.

(10) Patent No.: US 10,405,416 B2
(45) Date of Patent: Sep. 3, 2019

(54) HIGH-VOLTAGE TANK FOR HIGH-VOLTAGE GENERATION, INCLUDING A STRAIN GAUGE FOR TANK PRESSURE MEASUREMENT

(71) Applicant: SIEMENS HEALTHCARE GMBH, Erlangen (DE)

(72) Inventors: Christian Hoffmann, Nuremberg (DE); Gerd Moersberger, Bubenreuth (DE)

(73) Assignee: Siemens Healthcare GmbH, Erlangen (DE)

( * ) Notice: Subject to any disclaimer, the term of this patent is extended or adjusted under 35 U.S.C. 154(b) by 0 days.

(21) Appl. No.: 15/874,196

(22) Filed: Jan. 18, 2018

(65) Prior Publication Data

US 2018/0206317 A1 Jul. 19, 2018

(30) Foreign Application Priority Data

Jan. 18, 2017 (DE) ..... 10 2017 200 766

(51) Int. Cl.

| | |
|---|---|
| ***H05G 1/06*** | (2006.01) |
| ***H01J 35/02*** | (2006.01) |
| ***H01J 35/16*** | (2006.01) |
| ***H05G 1/02*** | (2006.01) |
| ***H05G 1/54*** | (2006.01) |
| *H05G 1/10* | (2006.01) |

(52) U.S. Cl.

CPC ..... *H05G 1/06* (2013.01); *H01J 35/025* (2013.01); *H01J 35/16* (2013.01); *H05G 1/02* (2013.01); *H05G 1/54* (2013.01); *H01J 2235/023* (2013.01); *H05G 1/10* (2013.01)

(58) Field of Classification Search

CPC . H05G 1/06; H05G 1/10; H01J 35/025; H01J 35/16; H01J 2235/023; H05K 9/00; H05K 11/11; G06Q 50/12

See application file for complete search history.

(56) References Cited

U.S. PATENT DOCUMENTS

| | | | |
|---|---|---|---|
| 2007/0201216 A1 | 8/2007 | Deuringer et al. | |
| 2017/0018042 A1* | 1/2017 | Pudipeddi ..... | G06Q 50/12 |

FOREIGN PATENT DOCUMENTS

| | | | |
|---|---|---|---|
| DE | 2148768 | A1 | 6/1972 |
| DE | 102004007230 | A1 | 9/2005 |
| DE | 202016000716 | U1 | 3/2016 |
| DE | 202016000716 | U1 | 4/2016 |

* cited by examiner

*Primary Examiner* — Harshad R Patel
*Assistant Examiner* — Nigel H Plumb
(74) *Attorney, Agent, or Firm* — Laurence Greenberg; Werner Stemer; Ralph Locher

(57) ABSTRACT

A housing for a high voltage tank has a boiler which is open on one side and a circuit board cover which closes the boiler. At least one strain gauge is arranged on or in the circuit board cover such that it is expanded or compressed with a pressure-induced deformation of the circuit board cover. A housing of this type is particularly suited as a high voltage tank for an x-ray emitter. An impermissible pressure in the housing for a high voltage tank can be determined easily and reliably.

8 Claims, 1 Drawing Sheet

HIGH-VOLTAGE TANK FOR HIGH-VOLTAGE GENERATION, INCLUDING A STRAIN GAUGE FOR TANK PRESSURE MEASUREMENT

CROSS-REFERENCE TO RELATED APPLICATION

This application claims the benefit, under 35 U.S.C. § 119, of German patent application DE 10 2017 200 766.4, filed Jan. 18, 2017; the prior application is herewith incorporated by reference in its entirety.

BACKGROUND OF THE INVENTION

Field of the Invention

The invention relates to a housing for a high voltage generation tank. The housing has a boiler which is open on one side and a circuit board cover which closes the boiler. The invention also relates to a high voltage tank for high voltage generation with a housing of this type. The invention also relates to an associated method for operating a high voltage tank.

A high voltage tank (acronym: HVT) is required to generate a high voltage for an x-ray emitter when x-ray radiation is generated. The HVT is frequently embodied in a boiler design having a metallic housing filled with a liquid insulating medium. On the one hand, the high voltages required for generating x-ray radiation can thus be realized in a small installation space. On the other hand, the resulting heat losses of the electrical components can be effectively absorbed by the liquid insulating medium, for instance an insulating oil, due to its high thermal capacitance, and distributed by the convection of the same in the event of temperature differences. In such cases the insulating oil heats up and expands.

Known mineral insulating oils have a thermal expansion coefficient of between 700 and 950 ppm/K. Since the insulating oil cannot be compressed, one constructional possibility of compensating for the change in volume (for instance expansion vessel, surge tank) of the insulating oil is required in the x-ray emitter and HVT. Elastic expansion tanks are known. A so-called expansion tank is typically manufactured from an oil-resistant membrane material (nitrile, silicon, etc.) with insulating properties. On account of the pressure of the expanding insulating oil, the membrane is deformed and compressed and thus provides for a pressure compensation.

On account of this compensation mechanism, internal pressures in the boiler of the HVT are avoided with rises in temperature, wherein in practice however naturally only limited expansion volumes can be made available. If the available electronic temperature sensors fail or the function of the membrane is damaged or restricted (e.g. with an incorrect basic setting or due to aging effects which result in stiffening of the compensation membranes for instance), such high pressures develop in the boiler, which can burst the boiler. Therefore, according regulations concerning pressure vessels, the oil-filled boilers must at least briefly be able to withstand the expected pressure which may occur three times.

If a thin-walled deep-drawing boiler with a two-dimensionally closing circuit board cover is used together with electrical interface functions (power supply lines, measurement signals, connection technology etc.), deformations of the boiler are already triggered with a slight positive pressure on the inside of the boiler (especially due to heat development).

The functionality of the HVT is compromised here by the following risks:

- occurring shearing forces, which can significantly damage the seals; it may result in insulating oil escaping.
- if further safety functions (membranes, temperature sensors) fail, the inner pressures may build up until the boiler bursts.
- parts of the interface function of the circuit board cover can be impaired or significantly damaged even with minimal mechanical tensions.
- compactness testing of the high voltage generation device for ensuring that no insulating oil loss can occur during the service life, with three-times the maximum operating pressure.

Impermissibly high pressures can be determined by a pressure sensor which measures the pressure in the boiler directly. The outer air pressure must however be supplied to the pressure sensor on the rear side (relative pressure measurement), as a result of which the pressure sensor must inevitably be embedded in the boiler wall, which requires an additional opening and extensive cabling.

Alternatively, the absolute pressure of the insulating oil can also be measured in the closed boiler, wherein two sensors are required however: one for the insulating oil and a second for the surrounding atmosphere. When a high voltage generation tank is produced, this results in matching and accuracy problems.

For safety reasons, in most cases an additional pressure switch for emergency shutdown is therefore integrated (=a further opening in the boiler wall). The pressure switch is however a mechanical component with correspondingly high pressure tolerances for the switching torque. Moreover, mechanical pressure switches are only suitable from a minimum pressure difference of approx. 0.5 bar.

SUMMARY OF THE INVENTION

It is accordingly an object of the invention to provide an encasement for a high-voltage tank which overcomes the above-mentioned and other disadvantages of the heretofore-known devices and methods of this general type and which provides for a novel and improved housing for a high voltage tank, a high voltage tank and a method for operating a high voltage tank, which can detect pressure variations on the inside of the housing.

With the foregoing and other objects in view there is provided, in accordance with the invention, a housing for a high voltage tank for high voltage generation, the housing comprising:

- a boiler having an opening on one side;
- a circuit board cover disposed to close said opening of said boiler; and
- at least one strain gauge disposed on or in said circuit board cover such that said at least one strain gauge is expanded or compressed with a pressure-induced deformation of said circuit board cover.

The objects of the invention are achieved with the housing, the high voltage tank and the method for operating a high voltage tank of the independent claims. Advantageous developments are specified in the dependent claims.

Since the mechanical stability of a circuit board cover lies clearly below that of a boiler of a housing of a high voltage tank, the pressure differences on the inside of the housing firstly appear as a deformation on the circuit board cover (as an outward bulge with a positive pressure and as an inward bulge with a negative pressure). In accordance with the invention, this deformation is detected directly by means of a strain gauge and is used for monitoring or, if a threshold is reached, for switching off.

To this end, the strain gauge can be glued externally onto the circuit board cover or integrated into the circuit board cover. The strain gauge has a pressure or deformation-dependent resistance. A downstream test circuit, for instance in the form of a half or full bridge (e.g., a Wheatstone bridge), can detect the changes in the resistance of the strain gauge as a result of the mechanical deformations.

The invention claims a housing for a high voltage tank for high voltage generation, having a boiler which is open on one side and a circuit board cover which closes the boiler, wherein at least one strain gauge is arranged on or in the circuit board cover such that it is expanded or compressed with a pressure-induced deformation of the circuit board cover.

In one development, the boiler is a so-called Gastronorm container. Gastronorm is a popular international container system, which, by using standard sizes, allows food containers to be easily replaced and is employed in food-processing businesses as well as in commercial kitchens. The use of a Gastronorm container is a cost-effective variant for a deep-drawn boiler.

The invention is advantageous in that an impermissible pressure in a housing for a high voltage tank can be determined easily and reliably.

In accordance with an added feature of the invention, an insulating oil can be present in the inside of the housing.

In accordance with an additional feature of the invention, the housing has a test circuit configured to detect changes in resistance in the strain gauge.

In accordance with another feature of the invention, the test circuit comprises a Wheatstone bridge circuit.

In a further design, an electric safety circuit connected electrically to the test circuit may be present, which is embodied to switch off a high voltage generation with a predeterminable limit value of a change in resistance in the strain gauge.

With the above and other objects in view there is also provided, in accordance with the invention, a high voltage tank for high voltage generation having a high voltage transformer, which is arranged inside a novel housing as outlined above.

Finally, there is also provided a method for operating a high voltage tank according to the invention, wherein the high voltage generation is switched off with an expansion or compression of the strain gauge which exceeds a predeterminable limit value.

Other features which are considered as characteristic for the invention are set forth in the appended claims.

Although the invention is illustrated and described herein as embodied in a housing for a high voltage tank, high voltage tank for high voltage generation and method for operating a high voltage tank, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
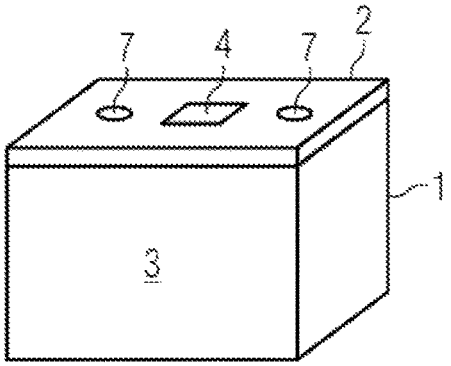
FIG. 1 shows an oblique view of a housing with strain gauges.

Referring now to the figures of the drawing in detail and first, particularly, to FIG. 1 thereof, there is shown a perspective view of a housing, or encasement, of a high voltage tank for high voltage generation. The housing has an upwardly open boiler 1 or vessel, which is sealed in a pressure-tight manner with a circuit board cover 2. Inside the housing, there is disposed a high voltage transformer in an insulating oil 3. A strain gauge 4 is glued to the circuit board cover 2 and is connected to a test circuit (not shown). FIG. 1 does not show an impermissible positive pressure in the housing. The circuit board cover 2 is flat and not arched or deformed. The compensation membranes 7 for pressure compensation are not stressed.

Figure 2:
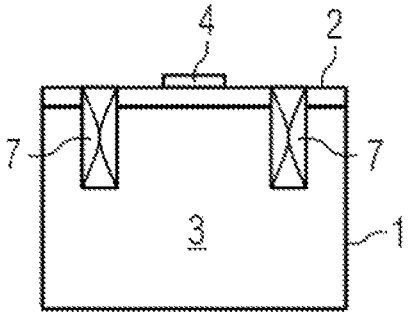
FIG. 2 shows a cross-section of a housing with an arched circuit board cover with strain gauges.

FIG. 2 shows a cross-section taken through a housing according to FIG. 1. Here, the insulating oil 3 inside the boiler 1 is expanded by a rise in temperature and has already completely compressed the compensation membranes 7. The pressure on the inside of the housing is so large that the circuit board cover 2 is arched outwards and as a result expands the strain gauge 4. The change in resistance caused by the expansion can be determined with the aid of the test circuit.

The basic state can be determined and changes detected and assessed by means of the test circuit, having AD converters/FPGA and associated software. Before damage-relevant deformations can occur, the high voltage generation can thus be switched off with the aid of the safety circuit. As a result, the temperature in the inside, which results inter alia in a higher pressure, can be reduced for instance. If a rare age-induced failure of the membranes occurs, this damage can be determined before the insulating oil can escape from the housing. This must be avoided at all costs due to the detrimental environment effects of the insulating oil 3.

The deformation of the circuit board cover 2 and its determination with the strain gauge 4 has been detected experimentally for a 3.2 mm thick circuit board cover 2. In such cases a somewhat parabolic association is indicated between the expansion of the strain gauge 4 and force on the circuit board cover 2.

Figure 3:
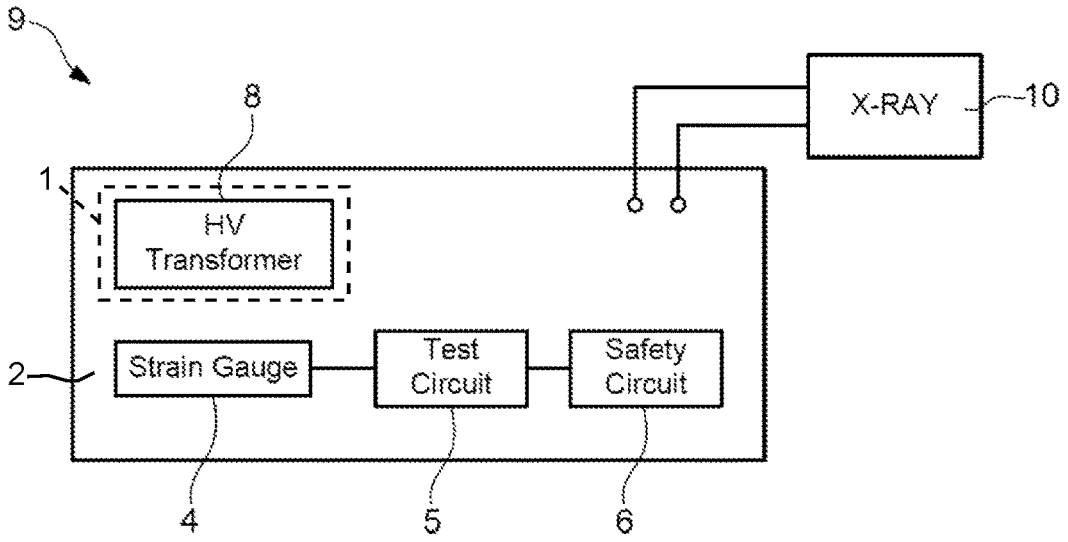
FIG. 3 shows a block diagram of a circuit arrangement for determining a positive pressure in a housing and also indicates the transformer inside the housing.

FIG. 3 shows a block diagram of a circuit arrangement for determining a positive pressure in a housing of FIG. 1 and FIG. 2. The strain gauge 4 is electrically connected to a test circuit 5. The strain gauge 4 rests on the circuit board cover 2 of the housing. The test circuit may have a Wheatstone bridge for assessment. The test circuit 5 is connected to a safety circuit 6, which ensures that the high voltage generation is switched off if a predeterminable pressure in the boiler 1 is exceeded. As a result, the insulating oil can cool down and the pressure decreases. A high voltage transformer

8 is located inside the boiler 1. All in all it is part of a high voltage tank 9 for an x-ray emitter 10.

The HVT typically also contains a sensor for the oil temperature. Since the pressure and temperature are inevitably associated after closing the boiler 1, the P-T curve (in other words the change in the strain gauge 4 as a function of the oil temperature) can be recorded in a calibration step (e.g. during the otherwise necessary testing of the boiler 1), and is continuously monitored during further operation. In this way it is not only an oil loss that can be detected by a leak in the HVT, (the pressure would be too low for the current temperature), but also a gas formation as a result of flashovers in the oil (due to the gas the pressure would be too high for the current temperature). These two problems were previously not detectable using conventional technology (temperature or pressure switch).

Although the invention has been illustrated and described in detail by the preferred exemplary embodiments, the invention is not restricted by the examples given and other variations can be derived therefrom by a person skilled in the art without departing from the protective scope of the invention.

The following is a summary list of reference numerals and the corresponding structure used in the above description of the invention:

1 Boiler, vessel
2 Circuit board cover
3 Insulating oil
4 Strain gauge
5 Test circuit
6 Safety circuit
7 Compensation membrane
8 High voltage transformer
9 High voltage tank
10 X-ray emitter

The invention claimed is:

1. A housing for a high voltage tank for high voltage generation, the housing comprising:
a boiler being open on one side;
a circuit board cover disposed to close said boiler; and
at least one strain gauge disposed on or in said circuit board cover such that said at least one strain gauge is expanded or compressed with a pressure-induced deformation of said circuit board cover.

2. The housing according to claim 1, further comprising insulating oil contained on the inside of said housing.

3. The housing according to claim 1, wherein said boiler is a Gastronorm container.

4. The housing according to claim 1, further comprising a test circuit configured to detect changes in a resistance in said at least one strain gauge.

5. The housing according to claim 4, wherein said test circuit comprises a Wheatstone bridge circuit.

6. The housing according to claim 1, further comprising a safety circuit electrically connected to said test circuit and configured to switch off a high voltage generation upon detecting a change in resistance of said at least one strain gauge has reached a limit value.

7. A high voltage tank for high voltage generation, comprising:
a housing according to claim 1; and
a high-voltage transformer disposed in said housing.

8. A method for operating a high voltage tank, the method comprising:
providing a housing according to claim 1 with a high-voltage transformer in the housing;
generating high-voltages with the high-voltage transformer; and
monitoring the strain gauge of the housing and, when an expansion or a compression of the strain gauge exceeds a predeterminable limit value, switching off the high voltage generation.

* * * * *